United States Patent [19]

Schoenfield et al.

[11] 4,217,724

[45] Aug. 19, 1980

[54] INTERLOCKING WHEELED FIGURE CONSTRUCTION TOY

[75] Inventors: Palmer J. Schoenfield, Evanston; Denise Gardner, Downers Grove; Howard J. Morrison, Deerfield, all of Ill.

[73] Assignee: Marvin Glass & Associates, Chicago, Ill.

[21] Appl. No.: 956,919

[22] Filed: Nov. 2, 1978

[51] Int. Cl.[3] ..... A63H 33/00; A63H 11/10; A63H 11/00; A63F 9/08

[52] U.S. Cl. ..... 46/22; 46/202; 46/103; 46/106; 46/135 R; 273/160

[58] Field of Search ..... 46/16, 17, 135 R, 97, 46/100, 103, 104, 134, 131, 1 R, 11, 22, 64, 47, 49, 72, 73, 74 R, 61, 62; 273/160, 156; 40/503, 504, 505, 415

[56] References Cited

U.S. PATENT DOCUMENTS

| | | | |
|---|---|---|---|
| 1,223,287 | 4/1917 | Morse | 46/104 |
| 3,012,367 | 12/1961 | Neumann | 46/22 |
| 3,316,672 | 5/1967 | Dixon | 46/64 |
| 3,579,901 | 5/1971 | Perhocs, Jr. | 46/103 |
| 3,630,527 | 12/1971 | Breslow | 273/160 |
| 3,736,696 | 6/1973 | Laird et al. | 273/160 |
| 3,805,444 | 4/1974 | Adickes | 46/17 |
| 3,936,974 | 2/1976 | House | 46/61 |

*Primary Examiner*—Louis G. Mancene
*Assistant Examiner*—Michael J. Foycik, Jr.
*Attorney, Agent, or Firm*—Mason, Kolehmainen, Rathburn & Wyss

[57] ABSTRACT

A mechanical construction toy for children of preschool age which can be assembled to form a robot. The construction toy has several parts which may be arranged in order to construct or build the robot. Three of the parts form a plane of carriage upon and about which the weight and moment of the toy rest and travel. The various parts are engageable with one another to provide several slip-type joints which permit the toy to take a variety of shapes or poses. The toy, when constructed, takes the shape of a robot and is an object of amusement as well as an education to the child.

10 Claims, 6 Drawing Figures

INTERLOCKING WHEELED FIGURE CONSTRUCTION TOY

BACKGROUND OF THE INVENTION

The present invention relates to a construction toy for children of preschool age. The invention has a plurality of sections or main elements and a plurality of arm and wheel parts which when properly assembled form a robot toy structure capable of being pulled over a supporting surface. There are presently available various types of puzzle games which require certain components to be interengaged in a particular order, and which when interengaged form an elongated structure. However, the present invention requires that the child assemble all the parts of the toy in such a fashion that he is required to contemplate balance as well as mechanical interconnectability.

SUMMARY OF THE INVENTION

In the preferred embodiment of the present invention the main elements are generally disc-shaped with interengaging surfaces and various parts which must be attached if the overall structure is to maintain balance and still be capable of traveling across the surface. The invention includes various protuberances and interengaging structures which require the child of preschool age to associate size, shape and function before proper assembly. The toy when completely structured not only teaches the child the principles of mechanical structure and structural balance but also provides entertainment for the child.

Important objects of the present invention are to provide a new and improved construction toy for teaching the structural interrelationship of parts, the requirements of structural balance and provide entertainment and amusement for the child.

Other objects, features and advantages of the invention will become apparent from the following detailed description taken in connection with the accompanying drawings.

DESCRIPTION OF THE PREFERRED EMBODIMENT

Figure 1:
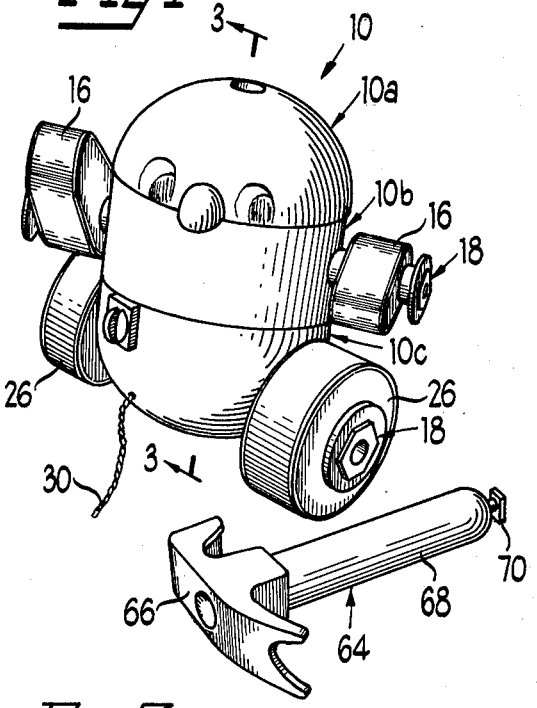
FIG. 1 is a perspective view of a construction toy embodying the concepts of the present invention.
Figure 3:
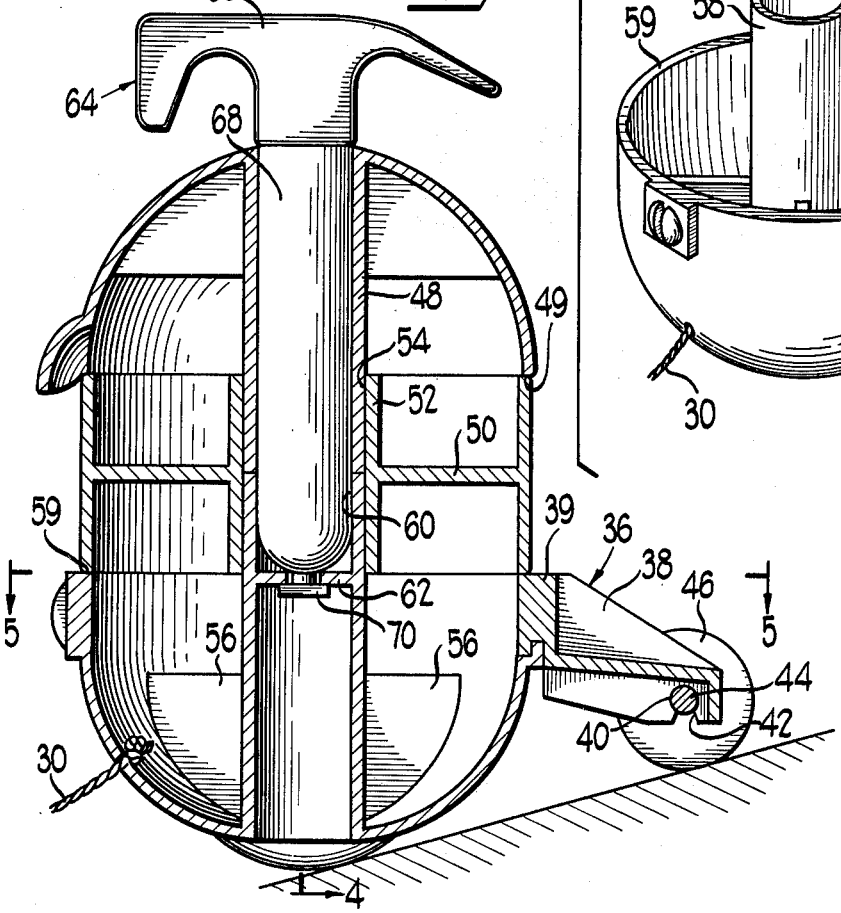
FIG. 3 is a vertical section of a toy embodying the concepts of the present invention, on an enlarged scale, taken generally along line 3—3 of FIG. 1.
Figure 2:
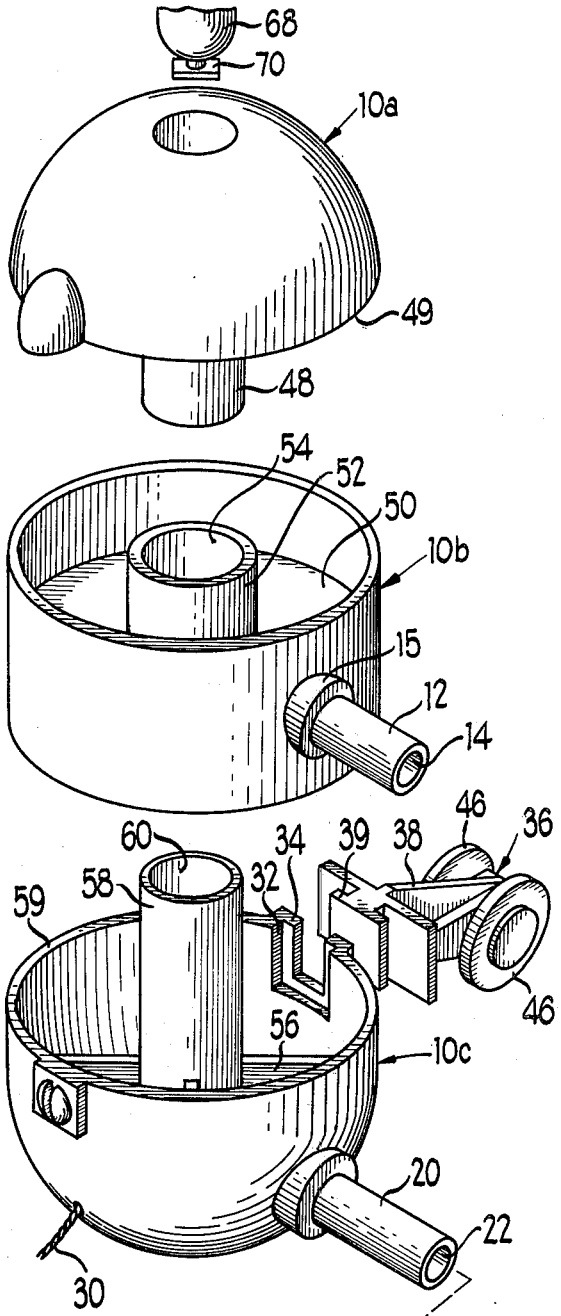
FIG. 2 is an exploded perspective view, on an enlarged scale, of a toy embodying the concepts of the present invention.
Figure 2:
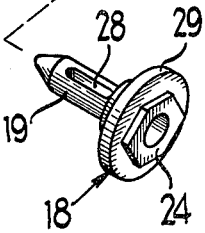
Figure 4:
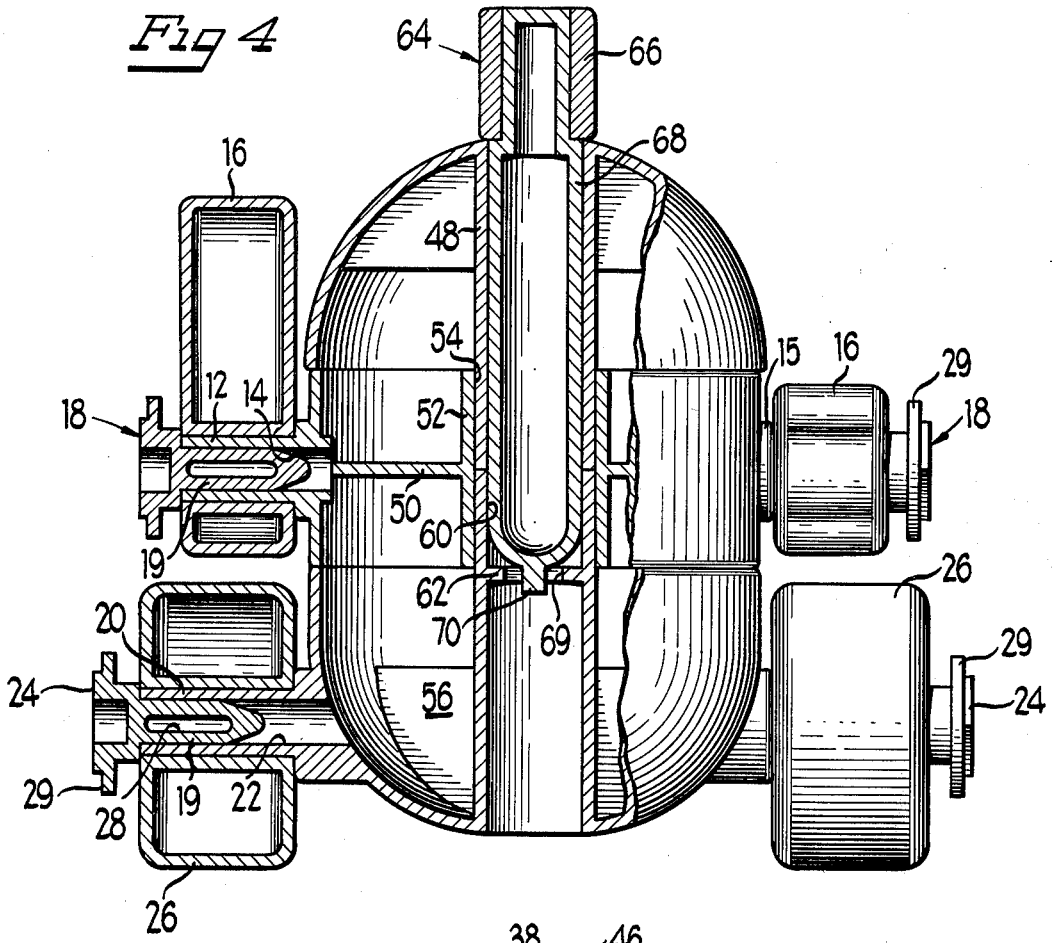
FIG. 4 is a partial section view, on an enlarged scale, taken generally along line 4—4 of FIG. 3.
Figure 5:
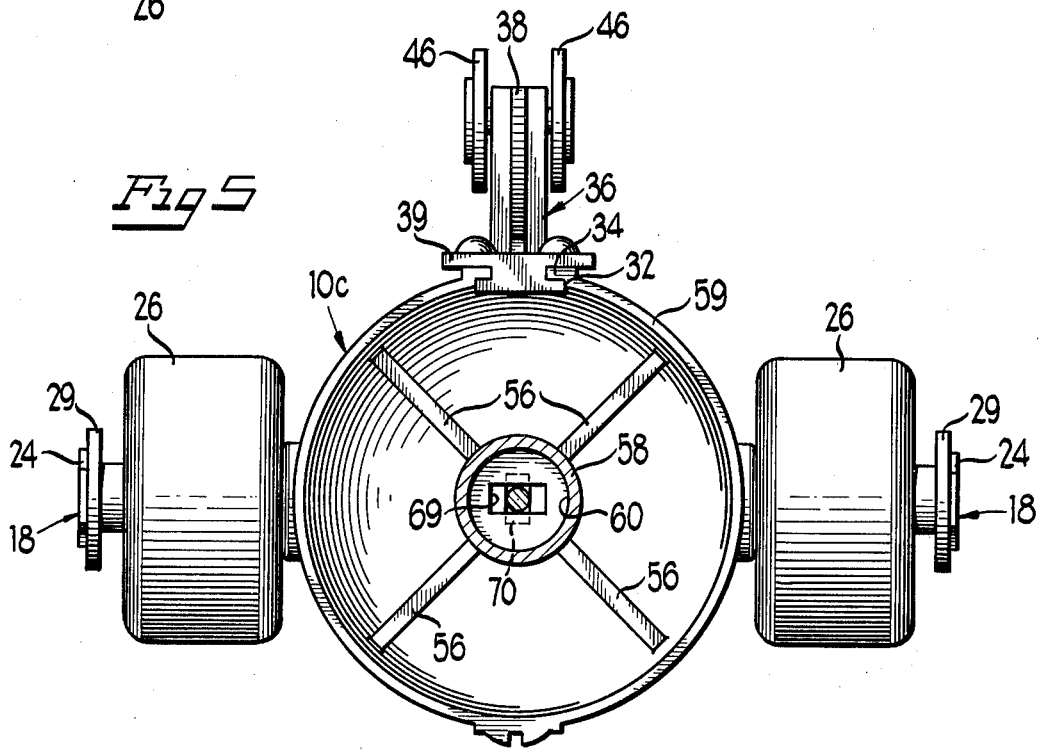
FIG. 5 is a sectional view taken generally along line 5—5 of FIG. 3.

The robot type construction toy of the present invention, generally designated 10, comprises three generally disc-shaped sections generally designated **10*a*, 10*b* and 10*c*, which have substantially identical diameters at their mating surfaces and when assembled define a generally cylindrical elongated main body. The end sections generally designated 10*a* and 10*c* are generally semispherical in shape so that when the sections are fitted together as shown in FIGS. 1, 3 and 4, a three-dimensional object, appearing as the body or torso portion of a robot is formed. The middle section 10*b* includes a pair of side protuberances or shafts 12 which are generally cylindrical in shape. Each shaft 12 includes an inner bore 14 and a generally concentric shoulder 15. A pair of arms of extremities 16 which include bores slightly larger than the outside diameter of shafts 12 are provided for mounting on shafts 12 of the middle section. Each arm 16 is generally oblong in shape and tapered at the end opposite the apertured end to further enhance the appearance of the toy robot. The arms 16 are secured to the shafts 12 by the use of friction pins 18. Each friction pin 18 (referring to FIG. 2) has a long cylindrical shaft portion 19 with the outside diameter of the cylindrical shaft portion 19 being slightly smaller than the bore 14 of the shaft 12, and an expanded hub portion 29 being substantially larger than the bore of the arm 16. The friction pin 18 is inserted into the bore 14 to secure the arm 16 in rotatable communication with the shaft 12 to permit the arms 16** to be set at various positions or poses.

The bottom section **10*c* also includes two shouldered shafts 20 which are generally similar in construction to those defined on the section 10*b*, that is, they are generally cylindrical in shape and contain a bore 22 intended for receiving a friction pin 18. Two wheels 26 are provided for mounting on the shafts 20. More particularly, each wheel 26 is mounted on one of the shafts 20 of the lower section 10*c* and secured thereon by a similar friction pin 24 (FIG. 3**).

The friction pins 24 each include a long cylindrical shaft 19 and an expanded hub portion 29. The shaft portion 19 is of larger diameter than the mounting bore and therefore each shaft 19 includes a transverse slot 28. This large diameter frictionally engages the bore 22 to rigidly mount the wheels 26 thereon and requires the use of a tool 64 to remove the pins 24. The expanded hub portion 29 is generally cylindrical in shape, substantially larger than the bore of the wheel 26 and provided with a simulated nut of hex head shape 24. When properly mounted the wheels are rotatable on the shafts 20 thereby giving the visual appearance of a robot and at the same time providing means for movement across a surface. The lower section **10*c* includes a pull string 30 which may be used to pull the completed toy across a supporting surface. The bottom section 10*c* also includes to the rear thereof approximately 90° from the shafts 20, a generally square shaped, slotted section 32, having an outer lip 34** generally in the form of an L-channel for engagement with a third stabilizing balancing wheel means.

The balancing wheel means 36 includes a frame 38 which has a generally I-shaped bracket 39 on one end for engagement of the slotted portion 32 of the lower section **10*c*. The bracket 39 is of a vertical and horizontal dimension equal to the dimensions of the slotted portion 32 so that a snug fit may be secured between the balance wheel frame 38 and the lower section 10*c*. Also included in the frame is a bearing 40 with a throated portion 42 intended for mounting a shaft 44 and two balance wheels 46. When the balance wheel means 36 is connected with the lower section 10*c* and the wheels 26** are mounted, they determine the plane of carrige about which the weight and moment of the toy are stably distributed for rolling support.

The top section **10*a* is generally hollow and similar in shape to the bottom 10*c*. A downwardly depending cylinder 48 extends through the hollow cavity past the lower interfacing surface 49 of the top section 10***a*. The axis of the cylinder 48 intersects the radial center of the generally semispherical top section 10*a* and uniformly intersects the inner wall of the top section 10*a* at the uppermost point. The outer surface of the top section 10*a* is provided with decorative eyes and a nose portion which give the top section the appearance of the face of the robot.

The middle section 10*b* of the toy is also generally hollow having an inner horizontally disposed circular wall 50 supporting an inner collar 52. The inner collar 52 is generally cylindrical in shape and concentrically mounted with reference to the center of the middle section 10*b*. The collar 52 contains a generally cylindrical bore 54 and is larger than the outside diameter of the cylindrical portion 48 of the upper section 10*a* and is intended for receiving insertion of the extending portion 48 thereof.

The lower section 10*c* is also generally hollow and has four generally vertically disposed, radial ribs. The bottom section 10*c* includes an upwardly extending column 58 which extends above the upper interface surface 59 of the bottom section 10*c*. The upwardly extending column 58 is generally cylindrical in shape and is received by the vertically disposed ribs 56. The column 58 includes a generally cylindrical bore 60 which opens to the top. Approximately midway down the length of the column 58 is mounted an inner membrane wall 62. A keyway 69 or opening is provided in the wall 62. The insertion of the cylinder 48 of the upper section 10*c* and the column 58 into the collar 52 properly aligns the top section 10*a* and the bottom section 10*c* for proper interfacing with the middle section 10*b*, thereby defining the elongated cylindrical structure.

The invention as contemplated also includes a locking means, generally designated 64 to secure the assembly. In the preferred embodiment, the locking means 64 has the overall general appearance of a hammer and includes a top portion 66, cylindrical shaft portion 68, and a key 70 on the bottom of the shaft portion 68. When the locking means is inserted with the key 70 within the keyway 69 and rotated, the sections 10*a*, 10*b* and 10*c* are locked in position. The length of the shaft 68 of the locking means 64 is such that the key 70, which is attached to the bottom of the shaft 68, reaches just below the inner membrane wall 62. The key 70 is generally of identical shape to the keyway 69 but the key 70 dimensions are slightly smaller so as to allow insertion of the key 70 through the keyway 69. Upon sufficient rotation of the locking means 64, the key 70 rotates within the lower section 10*c* thereby causing it to be secured within the lower section 10*c*. When it is desired to take the structure apart, one need only rotate the locking device 64 so that the dimensions of the key 70 are properly aligned with those of the keyway 69 to allow the key 70 to be pulled upwardly through the keyway 69 thereby allowing removal of the locking device 64 from the overall structure and allowing the pieces of the device to be disengaged.

The foregoing detailed description has been given for clearness of understanding only and no unnecessary limitations should be understood therefrom as some modifications will be obvious to those skilled in the art.

We claim:

1. A toy robot, comprising:

an upper and lower torso portion, each including at least one peripheral interfacing surface defining a plane and a connecting post normal to and through said plane;

a central cylindrical torso portion including a pair of surfaces for engaging the interfacing surfaces of the upper and lower housing portions, a centrally positioned circular web and an aligning post mounted in the center thereof and extending in both directions therefrom for receiving the connecting posts of said upper and lower torso portions;

means for securing the aligned torso sections as a unitary structure comprising the aligning post being sized to receive the connecting posts for alignment and a locking element and a keyed locking rib in one of said connecting posts;

a pair of arms rotatably mounted on a pair of generally oppositely extending shafts provided on the central housing portion; and support means on said lower housing portion comprising a plurality of rotatably mounted wheels for rollably supporting the toy on a suitable surface.

2. The toy robot of claim 1 wherein said wheel means comprises a pair of substantially large wheels rotatably mounted on the opposite sides of the lower housing portion and a balancing support secured to said housing portion for contacting the support surface for supporting the toy at an angle relative to the supporting surface.

3. The toy robot of claim 2 including indicia on the upper housing portion defining at least a pair of eyes and a nose for the facial portion of the robot.

4. The toy robot of claim 3 including a pull string for facilitating movement of the toy over a suitable supporting surface.

5. The toy robot of claim 1 wherein the connecting post of the upper torso portion defines an aperture through the upper end thereof.

6. The toy robot of claim 5 wherein said keyed locking rib comprises a transversely mounted web in the connecting post on said lower housing portion.

7. The toy robot of claim 6 wherein said locking element comprises a simulated hammer for insertion through the upper connecting posts, said hammer handle comprising a tab for extending through said keyed locking rib and securing the upper, lower and central torso portions as a unit in response to rotation thereof.

8. The toy robot of claim 7 wherein said plurality of rotatably mounted wheels comprises a pair of substantially large transversely and releasably rotatably mounted wheels on opposite sides of the lower housing portion and a balancing support secured to the lower housing portion for contacting the supporting surface and supporting the robot at an angle relative to the supporting surface.

9. The toy robot of claim 8 wherein said upper housing portion includes a radially extending nose portion adjacent its interfacing surface for simulating the nose of the robot.

10. The toy robot of claim 1 including a plurality of press fit means for removably and rotatably individually securing each of the arms or wheels to the respective housing portions.

* * * * *